United States Patent [19]

Peters et al.

[11] 4,287,741

[45] Sep. 8, 1981

[54] LUBRICATED TINPLATE FOR DRAWING AND IRONING OPERATION

[75] Inventors: Gordon L. Peters, Weirton, W. Va.; John R. Smith, Richmond, Ohio

[73] Assignee: National Steel Corporation, Pittsburgh, Pa.

[21] Appl. No.: 82,877

[22] Filed: Oct. 9, 1979

[51] Int. Cl.[3] ..... B32B 15/04

[52] U.S. Cl. ..... 72/42; 148/6; 252/49.5; 252/11; 252/56 S; 427/388.1; 428/457; 72/46; 113/120 A

[58] Field of Search ..... 148/6; 252/49.5, 11, 252/56 S; 427/388.1; 428/457; 72/42, 46; 113/120 A

[56] References Cited

U.S. PATENT DOCUMENTS

| | | | |
|---|---|---|---|
| 3,057,892 | 10/1962 | Groote | 252/56 S |
| 3,058,913 | 10/1962 | Traisa et al. | 252/56 S |
| 3,826,675 | 7/1974 | Smith et al. | 148/6 |

*Primary Examiner*—Marion McCamish
*Assistant Examiner*—E. Rollins Buffalow
*Attorney, Agent, or Firm*—Shanley, O'Neil and Baker

[57] ABSTRACT

Tinplate container stock coated with a substantially uniform film of lubricant, the lubricant film consisting essentially of a citric acid ester lubricant in an amount of at least 1.8 grams per basebox, and a method for its use in drawing and ironing operations.

14 Claims, No Drawings

LUBRICATED TINPLATE FOR DRAWING AND IRONING OPERATION

BACKGROUND OF THE INVENTION

1. Field of the Invention

This invention relates to lubricated tinplate container stock for use in the fabrication of seamless container bodies by the drawing and ironing process.

2. Description of the Prior Art

The fabrication of seamless metal container bodies by the drawing and ironing method is well known in the art. Such a method first involves drawing a metal blank into a shallow cup, i.e. "cupping" by forcing the blank through one or more drawing dies and then while supporting the drawn cup on a punch, passing the cup through one or more ironing dies, the inside diameters of which are progressively smaller, thus resulting in the thinning and elongation of the sidewalls of the cup. Because of the severe stress placed on the metal blank in such operations, a lubricant is required to allow the metal to flow more smoothly during the drawing and ironing, thus more uniformly distributing the stresses and avoiding the tearing or galling which could otherwise occur. Such lubrication is most important during the ironing stage where it also acts as a coolant, but some amount of surface lubricant is needed on tinplate during the initial cupping operation. Consequently, it is customary to apply a concentrated form of the lubricant/coolant to the blanks just prior to cupping.

A variety of lubricants have been developed for such purposes and they are well known in the art. For example, U.S. Pat. No. 3,873,458 describes the application of a combined resin and oil lubricant from an aqueous dispersion or emulsion while U.S. Pat. No. 3,994,252 discloses the use of a pre-annealing rinse including $MnSO_4$ which when subsequently dried forms an MnS lubricant coating on steelplate.

Notwithstanding the prior art use of lubricants in drawing and ironing operations, galling problems persist with some frequency and overheating of the tooling is a common occurrence. Equally objectionable are the surface scratching and "tin wipe" imperfections commonly experienced in such drawing and ironing operations. "Tin wipe" is a condition characterized by an unsightly frosted area on the sidewall of an otherwise bright reflective container. These problems have been virtually overcome by the present invention which will be described in greater detail below.

SUMMARY OF THE INVENTION

The present invention provides lubricated tinplate container stock which is particularly suitable for use in drawing and ironing processes where it may be utilized without applying additional lubricants thereto prior to the initial "cupping" operation.

The tinplate stock material is coated with a substantially uniform film of a citric acid ester lubricant in an amount of at least 1.8 grams per basebox, preferably 1.8 to about 4 grams per basebox. The citric acid ester lubricants used in the present invention are those having the following structural formula:

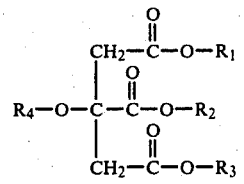

wherein $R_1$, $R_2$ and $R_3$ are individually selected from the group consisting of hydrogen and alcoholic residue containing 1-10 carbon atoms, $R_4$ is selected from the group consisting of hydrogen and carbocylic acid radicals containing 1-10 carbon atoms, and at least one of $R_1$, $R_2$ and $R_3$ is an alcoholic residue.

Any suitable tinplate container stock may be treated according to this invention, and the lubricant coating may be applied by any common method which is capable of depositing the desired weight of lubricant on the base metal, such as, for example, electrostatic deposition, branning, or, preferably, dipping, or roll-coating.

The resulting lubricated tinplate container stock may be processed in known drawing and ironing operations without developing attendant galling, scratching, or "tin wipe" problems.

DETAILED DESCRIPTION OF THE INVENTION INCLUDING PREFERRED EMBODIMENTS

In accordance with this invention, tinplate container stock is coated with at least 1.8 grams per basebox of a citric acid ester lubricant having the following structural formula:

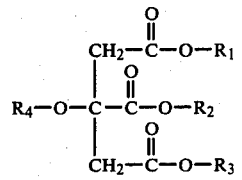

wherein $R_1$, $R_2$ and $R_3$ are individually selected from the group consisting of hydrogen and alcoholic residue containing 1-10 carbon atoms, $R_4$ is selected from the group consisting of hydrogen and carbocyclic acid radicals containing 1-10 carbon atoms, and at least one of $R_1$, $R_2$ and $R_3$ is an alcoholic residue.

Any suitable prior art tinplate container stock may be used in this invention. The construction of such tinplate materials and methods for their production are disclosed in numerous patents and textbooks. For example, tinplate is disclosed in the publication of U.S. Steel Corp. entitled *The Making, Shaping and Treating of Steel,* pages 996-1021 (7th Edition).

Excellent results are achieved when the tinplate stock is coated with between 1.8 to about 4 grams per basebox of the citric acid ester lubricant. The term "basebox" is used in this art to refer to a quantity of metallic container stock having a total surface area, that is the surface area of both sides, of 62,720 square inches. In other words, 1.8 to about 4 grams per basebox represent a coating weight of 8.6 mg/ft$^2$ to about 20 mg/ft$^2$. When applied to tinplate in the form of an emulsion, for instance, the specific content of citric acid ester lubricant required to achieve the desired coating weight may be easily determined by conventional methods. For example, as indicated hereinafter, an aqueous emulsion containing 5–10% by weight of acetyl tributyl citrate will provide excellent results.

Any suitable prior art method for coating metallic container stock may be used for applying the citric acid ester lubricant according to this invention. Examples of such prior art methods include electrostatic deposition, branning, applying a solution of the lubricant in a volatile solvent followed by evaporating the solvent, applying an aqueous emulsion of the lubricant followed by evaporating the water, immersing the tinplate in an aqueous emulsion and subsequently controlling the amount of coating with metering rolls, applying the lubricant per se directly to the container stock by means of the metering rolls, and spraying or the like when the solution is sufficiently fluid. When applied in emulsion form, the selected citric acid ester will be mixed with water and a suitable emulsifier, preferably a conventional non-ionic or anionic emulsifier.

The use of a citric acid ester of the type described herein as a lubricant was previously described in U.S. Pat. No. 3,826,675, but its use in that instance was limited to very thin coatings of 0.05–1.0 grams per basebox, and as such, while it provided metallic container stock with a significant number of beneficial characteristics, the coating thereon was too thin to prevent the galling, and "tin wipe" problems commonly associated with drawing and ironing operations.

Tinplate stock material which is treated according to this invention, i.e. lubricated with at least 1.8 g/basebox of a citric acid ester lubricant, does not require the application of additional lubricant prior to the initial cupping operation in a drawing and ironing process in order to avoid the galling, etc., problems described above.

In evaluating the effectiveness of the present invention, tinplated strip, produced on a conventional prior art electrolytic tinplating line, was sheared into sample sheets and coated, respectively, with the aqueous acetyl tributyl citrate (ATBC) emulsions listed below. A Standun luber was employed for the coating operation.

| % ATBC in the Emulsion | Emulsifier Ratio ml Renex 36/ml ATBC* | Applied ATBC Level g/BB |
|---|---|---|
| 5 | 50/1000 | 2.74 |
| 10 | 50/1000 | 3.81 |
| 10 | 50/1000 | 2.81 |
| 10 | 25/1000 | 1.88 |
| 10 | 25/1000 | 2.03 |
| 10 | 25/1000 | 2.34 |
| 10 | 25/1000 | 2.29 |
| 10 | 25/1000 | 2.63 |

*Renex 36 is a nonionic surfactant marketed by ICI (America) Inc.

Each sample sheet was processed through a commercial drawing press, i.e. "cupper", and in each case there was no galling evident and no surface imperfections were seen in the resulting cup.

When subjected to an ironing operation, lubricated tinplate according to this invention exhibited no "tin wipe" whereas tinplate coated with a conventional lubricant was ironed in substantially the same manner and showed a considerable "tin wipe" problem.

It should be understood that this invention may be embodied in other specific forms without departing from its spirit or essential characteristics. Accordingly, the present embodiments are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. In the drawing and ironing of tinplate stock wherein the stock material is provided with a lubricant coating prior to the drawing or cupping stage, the improvement comprising applying to the pre-drawn stock a substantially uniform film of lubricant consisting essentially of a citric acid ester having the structural formula

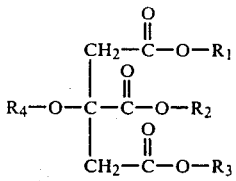

wherein $R_1$, $R_2$ and $R_3$ are individually selected from the group consisting of hydrogen and alcoholic residue containing 1–10 carbon atoms, $R_4$ is selected from the group consisting of hydrogen and carbocylic acid radicals containing 1–10 carbon atoms, and at least one of $R_1$, $R_2$ and $R_3$ is an alcoholic residue, the citric acid ester being present in a coating weight amount of at least 1.8 grams per basebox.

2. The method of claim 1 wherein the citric acid ester is applied in a coating weight amount of 1.8 grams per basebox to about 4 grams per basebox.

3. The method of claim 2 wherein the citric acid ester lubricant comprises a compound selected from the group consisting of triethyl citrate, acetyl triethyl citrate, tributyl citrate, acetyl tributyl citrate, acetyl tri-2-ethylhexyl citrate and admixtures thereof.

4. The method of claim 3 wherein the citric acid ester lubricant comprises acetyl tributyl citrate.

5. The method of claim 4 wherein the acetyl tributyl citrate lubricant is applied to the tinplate stock in the form of an emulsion.

6. A tinplate container stock having a substantially uniform film of lubricant on at least one surface area thereof, said film consisting essentially of a citric acid ester lubricant having the structural formula

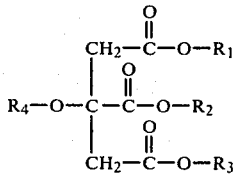

wherein $R_1$, $R_2$ and $R_3$ are individually selected from the group consisting of hydrogen and alcoholic residue containing 1–10 carbon atoms, $R_4$ is selected from the group consisting of hydrogen and carbocylic acid radicals containing 1–10 carbon atoms, and at least one of $R_1$, $R_2$ and $R_3$ is an alcoholic residue, in a coating weight amount of at least 1.8 grams per basebox.

7. The lubricated tinplate container stock of claim 6 wherein the coating weight amount of the citric acid ester lubricant is 1.8 grams per basebox to about 4 grams per basebox.

8. The lubricated container stock of claim 7 wherein the citric acid ester lubricant is a compound selected from the group consisting of triethyl citrate, acetyl triethyl citrate, tributyl citrate, acetyl tributyl citrate, acetyl tri-2-ehtylhexyl citrate, and admixtures thereof.

9. The lubricated container stock of claim 8 wherein the citric acid ester lubricant film consists essentially of acetyl tributyl citrate.

10. A method of producing lubricated tinplate container stock especially useful in drawing and ironing operations wherein the tinplate stock is coated with a substantially uniform film of lubricant, the improvement wherein the lubricant film consists essentially of a citric acid ester lubricant having the structural formula

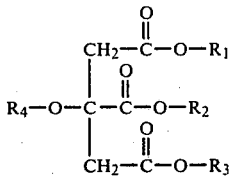

wherein $R_1$, $R_2$ and $R_3$ are individually selected from the group consisting of hydrogen and alcoholic residue containing 1–10 carbon atoms, $R_4$ is selected from the group consisting of hydrogen and carbocyclic acid radicals containing 1–10 carbon atoms, and at least one of $R_1$, $R_2$ and $R_3$ is an alcoholic residue, the coating weight of said citric acid ester being in an amount of at least 1.8 grams per basebox.

11. The method of claim 10 wherein the citric acid ester lubricant is applied in a coating weight amount of 1.8 grams per basebox to about 4 grams per basebox.

12. The method of claim 11 wherein the citric acid ester lubricant comprises a compound selected from the group consisting of triethyl citrate, acetyl triethyl citrate, tributyl citrate, acetyl tributyl citrate, acetyl tri-2-ethylhexyl citrate and admixtures thereof.

13. The method of claim 12 wherein the citric acid ester lubricant comprises acetyl tributyl citrate.

14. The method of claim 13 wherein the acetyl tributyl citrate lubricant is applied to the tinplate stock in the form of an emulsion.

* * * * *